US009475557B2

(12) United States Patent
Maechler

(10) Patent No.: US 9,475,557 B2
(45) Date of Patent: Oct. 25, 2016

(54) LIFE JACKET HAVING ADDITIONAL LIFESAVING MEANS AND LIFESAVING MEANS FOR ARRANGEMENT IN BUOYANCY AIDS OR LIFE JACKETS

(71) Applicant: Philip Maechler, Uetikon am See (CH)

(72) Inventor: Philip Maechler, Uetikon am See (CH)

( * ) Notice: Subject to any disclaimer, the term of this patent is extended or adjusted under 35 U.S.C. 154(b) by 0 days.

(21) Appl. No.: 14/443,739

(22) PCT Filed: Nov. 19, 2013

(86) PCT No.: PCT/IB2013/060251
§ 371 (c)(1),
(2) Date: May 19, 2015

(87) PCT Pub. No.: WO2014/076685
PCT Pub. Date: May 22, 2014

(65) Prior Publication Data

US 2015/0307171 A1 Oct. 29, 2015

(30) Foreign Application Priority Data

Nov. 19, 2012 (CH) ..... 2427/12
Nov. 19, 2012 (CH) ..... 2428/12

(51) Int. Cl.
*B63C 9/125* (2006.01)
*B63C 9/115* (2006.01)
(Continued)

(52) U.S. Cl.
CPC ..... *B63C 9/1255* (2013.01); *B63C 9/115* (2013.01); *B63C 9/18* (2013.01); *B63C 9/24* (2013.01)

(58) Field of Classification Search
CPC ..... B63C 9/15; B63C 9/18; B63C 9/20; B63C 9/1255; B63C 9/115; B63C 9/24; B63C 9/11; B63C 9/125; B63C 9/08; B63C 9/00; G08B 21/00; G08B 23/00
USPC ..... 441/106
See application file for complete search history.

(56) References Cited

U.S. PATENT DOCUMENTS 3,199,128 A 8/1965 Nojd
3,354,480 A 11/1967 Harding et al.
(Continued)

FOREIGN PATENT DOCUMENTS

CN 2310730 A 3/1999
DE 20 2007 006819 U1 11/2007
(Continued)

OTHER PUBLICATIONS

International Search Report of Mar. 18, 2014.
(Continued)

*Primary Examiner* — Lars A Olson
(74) *Attorney, Agent, or Firm* — Dienwiebel Transatlantic IP

(57) ABSTRACT

The invention addresses the basic problem of providing a lifesaving means 1 for a life jacket RW, wherein said life jacket offers a higher degree of buoyancy in an emergency. This is achieved in principle by inserting an additional lifesaving means 1 into a life jacket RW and activating the additional lifesaving means 1 via sensors S in conjunction with a control unit 9 or by manual actuation, such that the buoyancy is greater overall than that of the life jacket RW itself. Buoyancy that is reliable in an emergency is present if the body of a person can be kept above water without additional movement by the person. Depending on the clothing worn, the buoyancy is greater than 150N. Triggering preferably occurs automatically.

12 Claims, 4 Drawing Sheets

(51) Int. Cl.
*B63C 9/18* (2006.01)
*B60C 29/00* (2006.01)

(56) References Cited

U.S. PATENT DOCUMENTS

| | | | | |
|---|---|---|---|---|
| 3,771,183 | A | 11/1973 | Moran | |
| 4,498,882 | A | 2/1985 | Evert | |
| 5,453,033 | A | 9/1995 | Travinski | |
| 5,603,648 | A | 2/1997 | Kea | |
| 5,820,432 | A | 10/1998 | Wright | |
| 6,545,606 | B2 * | 4/2003 | Piri | B63C 9/0005 340/539.13 |
| 6,910,931 | B1 * | 6/2005 | Nakase | B63C 9/20 441/106 |
| 7,004,808 | B1 | 2/2006 | Nelson et al. | |
| 8,552,847 | B1 * | 10/2013 | Hill | G06F 3/016 116/205 |
| 8,941,476 | B2 * | 1/2015 | Hill | 116/200 |
| 9,327,703 | B2 * | 5/2016 | Hill | B60T 17/22 |
| 2006/0012483 | A1 | 1/2006 | Ethington | |
| 2006/0040574 | A1 | 2/2006 | O'Meara et al. | |
| 2010/0167608 | A1 | 7/2010 | Daye et al. | |
| 2011/0294382 | A1 | 12/2011 | Puls et al. | |
| 2013/0109260 | A1 | 5/2013 | Low | |

FOREIGN PATENT DOCUMENTS

| | | | |
|---|---|---|---|
| EP | 1918191 | A1 | 5/2008 |
| EP | 1961654 | A1 | 8/2008 |
| GB | 696 594 | A | 9/1953 |
| JP | 10119709 | A | 5/1998 |
| WO | 2004/007275 | A2 | 1/2004 |
| WO | 2010036207 | A1 | 4/2010 |

OTHER PUBLICATIONS

Search Report of CH 02427/12 of Mar. 6, 2013.
Search Report of CH 02428/12 of Mar. 6, 2013.

* cited by examiner

LIFE JACKET HAVING ADDITIONAL LIFESAVING MEANS AND LIFESAVING MEANS FOR ARRANGEMENT IN BUOYANCY AIDS OR LIFE JACKETS

BACKGROUND

The invention relates to a life jacket having additional lifesaving means for arrangement in flotation aids or flotation jackets, in particular for persons.

A life jacket is a lifesaving device which in particular provides additional buoyancy to a person who finds himself or herself in water. It is preferably an item of clothing designed in the shape of a jacket. This item of clothing generally has armholes through which the arms can be guided, while the other parts of the body, namely the back, chest and abdomen, are covered by the jacket. Closure elements such as a zipper, buckles or the like hold the life jacket in the required position on the body.

The term flotation jacket is known. However, this ought also to be understood as covering a life jacket. In terms of their appearance, flotation aids can also be compared with life jackets. Flotation aids have less buoyancy than life jackets.

Flotation aids are known in different designs and with different buoyancy properties. For example, so-called flotation jackets, kayaking jackets, rowing jackets, etc., are included in this category.

The appropriate size is dependent on the required buoyancy volume of the life jacket. This is calculated by the total weight of the wearer, including clothing and equipment, and the area of water being sailed on. The following classifications are provided:

- 50N buoyancy: flotation aid only for proficient swimmers close to shore or accompanied by a safety vessel; not safe if user unconscious; the flotation jackets, kayaking jackets or rowing jackets known from sports, and also jackets comparable to these, likewise generally have a buoyancy of ca. 50N and are also not safe if user unconscious;
- 100N buoyancy: life jacket for inshore waters and for protected coastal waters; safe only to a limited extent if user unconscious;
- 150N: life jacket for all waters, safe if user unconscious, but only to a limited extent if person is wearing heavy water-proof clothing;
- 275N: life jacket for the open sea and extreme conditions, safe in almost all cases if user unconscious, despite heavy clothing.

In the context of a particular specification, the life jacket is able to right even an unconscious person to a safe floating position and/or to maintain them in this position.

Lifesaving means for saving persons and animals, who for example come into unintended contact with deep water, are known in various embodiments. Among others, life jackets or flotation aids and buoyancy aids are known that are arranged directly on the body. These differ from one another mainly in terms of the buoyancy force provided but are very similar in terms of their function and construction.

On the basis of their buoyancy systems, life jackets can be divided into solid jackets and inflatable life jackets. Solid jackets have rigidly incorporated buoyancy means, as a result of which the jackets are of relatively large volume. The buoyancy means are made of solid material and, consequently, are not compressible or are only slightly flexible.

This life jacket with maximum buoyancy is intended to protect the person or animal from drowning and to keep said person or animal at least at the surface of the water. Such life jackets have a jacket shape (without sleeves) and can be fixed on the body of the wearer by means of one or more closure elements. To ensure that the life jacket bears properly on the body, leg straps or crotch straps are additionally provided which also hold the life jacket in position upon contact with water. Preferably, these life jackets have a corresponding signaling color. In order to provide a safe position on the water even if the wearer is unconscious, provision is made to arrange a collar element on the life jacket, such that the person comes to lie in a stable position on his or her back on the surface of the water, such that the head area is supported and the airways are thus kept free, particularly if the person is injured or no longer conscious.

Inflatable life jackets are generally worn folded up in a small format. When they are to be used, they are inflated by hand or automatically. This embodiment proposes a life jacket being provided in such a way that it has no static buoyancy bodies (consisting of solid) out of water. Instead, the buoyancy bodies are generated only when corresponding contact is made with the water. The triggering is generally effected by a kind of sensor element which, for example, is made available by a salt tablet (or another material that changes its properties in contact with water). This salt tablet releases a mechanism which permits a sudden flow of $CO_2$, which is stored in a container or a cartridge, into a body element. The body element is hose-like and arranged in a pouch around the neck. A belt-like construction, or life belt, secures the hose-like construction on the body of the wearer, particularly when the gaseous medium has flowed into the body element. The body element thus becomes a buoyancy element.

Flotation aids or buoyancy aids (so-called flotation jackets, canoeing jackets, kayaking jackets, fishing jackets, rowing jackets, etc.) are similarly constructed. However, in order to ensure greater freedom of movement for the wearer, these have smaller buoyancy bodies of solid material (approximate buoyancy 50N). Moreover, they do not generally have the corresponding head support to provide safety when the wearer is unconscious, namely a collar element.

As regards personal safety equipment, in particular for persons participating in water sports such as sailing or kayaking, life jackets or flotation aids (also often known as flotation jackets or kayaking jackets) tailored to the person are prescribed by law.

As regards safety equipment of this kind, the devices that provide safety when the person is unconscious are fundamentally distinguished from the devices that do not. That is to say, the latter are unable to keep the person's head safely above water and keep the airways clear when said person has lost consciousness or, for example, is injured. Therefore, such flotation aids, for example flotation jackets, are used mainly in sports activities, where help is generally quickly provided.

In the prior art, an inflatable device is also known which is worn by persons directly on the body. The safety device can be secured like a belt around the waist and abdomen and, upon contact with water, correspondingly fills with a gas. For this purpose, body elements are provided which are arranged like a belt on the system and which are filled with the gaseous element. Here too, the buoyancy body is provided only by inflation of the body element.

In further developments, provision is made for the lifesaving means to have electronic support elements.

The support elements are designed in such a way that, for example, the water pressure is measured. It is only at a certain water pressure that the body elements are triggered or inflated. This device is known, for example, from U.S. Pat. No. 6,246,329 B1.

However, in order to be able to operate such a device, it is necessary that an electrical unit is arranged. These electrical units, which among other things also contain a current supply and a timer, are arranged separate from the lifesaving means. The connections must be configured in such a way that they are waterproof and are able to function over a long period of time, since lifesaving means of the aforementioned type are generally stored for quite a long time either in rooms or boxes or are used on a daily basis and then have to perform their function in an emergency.

U.S. Pat. No. 5,603,648 discloses a lifesaving means consisting of a solid jacket. The latter has a certain buoyancy. As additional lifesaving means, a body element is integrated in the lifesaving means and in an emergency can be inflated by mouth by the user or is filled with air/gas from a cartridge. The latter is triggered by hand.

US 2006/0040574 A1 discloses a flotation aid in the form of a life jacket with low buoyancy, which additionally comprises a further buoyancy means. This further buoyancy means is arranged in the front area of the flotation aid and can be activated by manual triggering, with air/gas flowing from a cartridge into the additional buoyancy means as a result of this triggering.

If a person gets into an emergency situation at sea or in water, it is necessary for this person to have a life jacket arranged on the body. If the person is able to stay above water by his own strength, life jackets with a buoyancy of up to 100N are sufficient. However, if the person is unconscious, the lifesaving means has to supply enough buoyancy to ensure that the body, including the water-saturated clothing, remains above water. The person's head is also kept above water. However, life jackets with buoyancy forces of up to 100N may no longer meet this requirement. The person would drown. Wearing life jackets right from the outset that provide the relevant buoyancy force is uncomfortable and, particularly in sports activities, unusual. Particularly in sports such as water skiing, kayaking, rowing or also sailing, it is almost impossible, since the solid jackets are very rigid and do not permit movement. Automatic jackets have the disadvantage that they already activate at the initial contact with water and are then of such great volume that they do not allow the sport to be continued.

The mechanical loads for such lifesaving means are considerable. Therefore, these lifesaving means known from the prior art are of very compact construction and are generally uncomfortable for the persons who wear such lifesaving means, particularly those providing a high buoyancy force. The reason they are uncomfortable is that, in the case of solid lifesaving means (flotation body elements with defined buoyancy), a large volume is arranged directly on the body of the wearer, particularly also on the chest area. This leads to a feeling of being constricted, but also to limited movement, and therefore these lifesaving means are often not worn despite the corresponding regulations. In an emergency, it is generally too late to put on the lifesaving means. Moreover, the lifesaving means is visually very conspicuous, and this conspicuousness is not wanted by most persons.

The solid lifesaving means in particular are designed in such a way that, although they supply a defined buoyancy, an external impulse is needed so that, for example, a person face down in the water can be righted within a short time (if it is a lifesaving means providing safety when the wearer is unconscious). The external impulse is provided by a wave movement of the water, which gives the body the energy to right itself, so that it is transferred from an unstable position to a stable position.

Moreover, the automatic life jackets which propel gas into body elements for buoyancy, upon contact with water, are designed such that desired righting of the body does not take place. Instead it has been shown that, as a result of the lateral arrangement of the gas cartridge, inflation is undesirably staggered slightly, and a countermovement can occur which in an undefined manner sometimes prevents the desired supine position of the body. Here too, an external turning movement (for example the wave movement) is therefore needed to keep the body on the water, at least in a way that provides safety if the wearer is unconscious.

The aforementioned lifesaving means do not show the user whether it actually functions. For example, in the case of the automatic life jackets, if a salt tablet does not completely dissolve so as to trigger the release of the gas stored in a container into the body elements, no gas flows into the body element and the inflation does not take place. The lifesaving means thus has no function. Nevertheless, it is very clear to the observer that, from the display of the green indicators, which confirm only a partial function (e.g. filled gas cartridge), the function is performed. Consequently, reliability and absolute safety are not provided. In the case of solid life jackets, tactile and visual checks exclusively take place.

In all lifesaving means, it is necessary for fastenings to be provided in the crotch or leg area, since otherwise this lifesaving means moves over the body in the direction of the head as soon as the person is located in the water. If the fixing elements in the leg area are not properly applied, the lifesaving means may lose its function. Since there are many possible ways of putting such lifesaving means on, there is a danger of incorrect operation, with the result that the lifesaving means does not provide the desired assistance in an emergency.

Flotation jackets generally only have a slight buoyancy of 50N. Such jackets are used in sailing sports or comparable types of sports, since there is always contact with water. Therefore, self-triggering life jackets are not suitable.

Alternatively, flotation jackets are already known which contain an additional buoyancy element. However, it is always triggered manually and thus presupposes that the user is fully conscious. Therefore, this type of flotation jacket with additional buoyancy means is also not safe if the wearer has lost consciousness. The user is therefore at a considerable risk since, even in the area of sports, situations can arise in which the user becomes powerless or even unconscious.

SUMMARY

The problem addressed by the invention is that of making available lifesaving means which, in addition to the actual function of providing buoyancy assistance to a life jacket, ensures an automatic buoyancy that is safe in an emergency.

The solution to the problem is provided by the features of claim 1.

The basic concept of the invention in one embodiment is to make available lifesaving means for a life jacket that is safe if the user is unconscious, with the property of offering, in an emergency, an increased buoyancy force, which is provided automatically, i.e. without manual actuation.

This is achieved in principle by the fact that an additional lifesaving means is inserted into a life jacket or flotation aid and, in an emergency, sensors advantageously activate the additional lifesaving means, such that a buoyancy is provided which is then in total greater than the buoyancy of the life jacket itself. Buoyancy that is safe in an emergency is present if the body of the person can be kept above water without further movement by the person.

Depending on the clothing worn, the buoyancy in one embodiment may be greater than 150N. The additional buoyancy is in another embodiment provided in a manner such that the buoyancy is safe if the wearer is unconscious. This means that a device is made available in which the head is kept above water. For this purpose, an air-filled cushion may deploy under the head in another embodiment. Manual actuation is not required, since the safety in unconsciousness is present only when the buoyancy is provided without any action on the part of the user.

In principle, any type of lifesaving means is suitable which, in an emergency, provides buoyancy bodies that keep the stricken person above water. These can be inflatable body elements that are filled with gas, or body elements that generate gas when two substances are combined. Generally, additional body elements are inflated by a dedicated mechanism after the emergency situation has been detected.

In an embodiment, provision is also made that the person is kept in a correct position above water, in such a way that the airways are also free. This means that the person is held steadily in a supine position with a corresponding collar structure.

Based on this concept, flotation jackets or similar flotation aids for example, which have a correspondingly low buoyancy for helping the person swim, can be provided with at least one body element in such a way that this body element or further body elements inflate and/or deploy in an emergency and, in this way, the necessary buoyancy force is supplied. This is done automatically, but not directly upon contact with water, as is known from automatic life jackets.

The lifesaving means, which can be inserted into the flotation jacket for example, may be prefabricated such that, for example, clothing manufacturers or the manufacturers of flotation aids (e.g. flotation jackets, etc.) can incorporate the lifesaving means as a finished structural unit into the respective item of clothing or into the flotation aid or into a flotation jacket (OEM: original equipment manufacturer), for example without modifying the actual lifesaving means itself, here the flotation jacket. This has the advantage that the manufacturer of the lifesaving means can meet the prescribed safety conditions in full and can also assume the guarantee for the further processing, since the lifesaving means is not modified by the business that further processes the lifesaving means.

The lifesaving means itself in another embodiment has no movable parts and/or externally visible cables. Any elements, such as the device for storing and dispensing the gaseous medium, and also the control unit, may be integrated component parts of the lifesaving means.

The lifesaving means in another additional or alternative embodiment has two body elements which are either fluidically connected or are designed separately and independent of each other. The inflation of the body elements can take place in different ways. A control unit serves to detect the actual status via sensors and, if defined limit values are exceeded (for example water depth, water temperature, time in water, etc.), to trigger the inflation of the body elements.

A particular design of the lifesaving means according to another embodiment has the effect that, when the lifesaving means is active, i.e. inflated, discomfort in the user's chest area is avoided. This is achieved by said body elements comprising two limb elements and also a limb base, wherein the limb base is arranged around the back area of the neck and the two limb elements are arranged collaterally at the sides of a body under the arms, in particular below the armpit area. A U shape is formed in a plan view. Provision is made that some of the body elements may be arranged medially, ventrally and also dorsally. The body elements arranged at the sides are connected to the limb base. The limb base may be arranged dorsally on the body around the back of the neck and, in the inflated state, provides a suitable support function for the neck and head.

One of the advantages of the above embodiment with a lateral arrangement of the body elements is that the same large degree of buoyancy can be generated with a relatively small body volume, since the body elements can achieve a considerably greater displacement. The reason is that, regardless of the position of the body with respect to the surface of the water, and by comparison with the arrangement known from the prior art, these body elements are always in contact with water. In order here to ensure an optimal buoyancy property, the body elements in another embodiment are arranged at the sides of the body in such a way that, regardless of the position of the body (abdominal or supine position), a part, e.g, a large part, of the body elements is always below the surface of the water.

In another embodiment, provision is made that at least the limb elements have two mutually independent devices for storing and discharging a gaseous medium. This has the advantage that the discharge can take place staggered in time, which in turn leads to the advantage that the body wearing the lifesaving means can be righted to the correct position for safety in the event of unconsciousness. The staggered timing of the triggering is assumed by the control means in this embodiment. The multi-chamber principle brings with it the further advantage of redundancy. Should one body element be defective, sufficient buoyancy is still always provided by the further body element acting independently of the first body element.

In another embodiment, the staggered triggering is not only controlled via a time window, but also in such a way as to determine that a rotation actually takes place after the inflation of the first body element. By the further inflation, an impulse is created that supports the rotation movement in the correct direction. Only then is it ensured that the second inflation of the further body element also leads to a stabilization of the position. Otherwise, the rotation movement would be inhibited, and the position providing no safety in the event of unconsciousness would be maintained. This then leads to considerable damage to the body or to death, since the face still remains below the water line.

The body element in the limb base may also be triggered in a staggered manner. The triggering will take place only when a stable position is reached. The position itself can be established by suitable sensors. The triggering can take place either with the triggering of the second body element or by a further automatic trigger mechanism. In the limb base, the body element in another embodiment is arranged in such a way that, in the inflated state, it pushes itself out from the area of the back of the neck to a position under the head, such that a cushion-like support is obtained. Depressions may be provided in an additional embodiment in which the head can be held properly in position, such that the head is prevented from turning in the direction of the surface of the water, even when the wearer is unconscious.

In one further embodiment, the lifesaving means itself is designed in such a way that, even when the lifesaving means is in the inflated state, the person is still able to move through the water without sensing the lifesaving means as a great obstacle or barrier. This is achieved by the body elements being arranged collaterally and, in the underarm area, do not have the dimensions that they have in the waist area for example. Thus, when the lifesaving means is inflated, the person is able to move both in the prone position and also in the supine position.

The collateral arrangement of the body elements in the side area means that they seek to move only slightly in the direction of the head due to buoyancy in order to detach themselves from the body. However, in order to further block this movement, a tensioning element may be arranged under the body elements and contracts when the body elements inflate, such that a firm band forms in the lower area which is arranged in the person's waist area, such that the lifesaving means is prevented from slipping upward in the direction of the head.

As has been described above, the lifesaving means in one embodiment comprises the limb elements and the limb base. The greater part of the lifesaving means in another embodiment is formed by body elements that can be inflated by a gaseous medium. As is already known in the prior art, the body elements can be inflated by gas elements stored in $CO_2$ cartridges, for example. For this purpose, the body elements in one embodiment are designed in such a way that they are airtight, pouch-like elements into which the gas is introduced. They are either inelastic, such that the size is fixed, or they are elastic, in which case the outer envelope, i.e. the lining, or the elasticity thereof, predefines the limit. The triggering may take place via an automatic device with a control unit that detects the existence of an emergency situation. If the latter is confirmed, e.g., a percussive element that strikes the opening area of the cartridge causes the gas to flow out into the body elements.

However, means are also known which form corresponding gases by bringing two chemical substances together.

Particularly when the lifesaving means is designed for arrangement in clothing, flotation aids or life jackets, it is possible in an embodiment to provide this chemical medium, which is "initiated" by an electrical impulse. By the initiation, the chemical medium has a further chemical medium added to it, such that a gaseous medium is obtained which is suitable for inflating the body elements.

The media themselves may be arranged inside the body elements, such that a space-saving arrangement is possible. The two chemical media are suitable in such a way that they are provided for prolonged storage. A holder may be not present. The actual gaseous substance arises only when the two media are brought together.

The initiation itself, which may take place by an electrical impulse for example, is assumed indirectly by the control unit. The control unit likewise may be a component part of the lifesaving means and is understood as an integral component part of the lifesaving means. It is an integral component part in the sense that the control unit is incorporated into the lifesaving means, such that there are no water-permeable seams.

Connections, for example to electrical cables, are in one embodiment arranged inside the lifesaving means, such that accidental destruction of the electrical line from outside is excluded. A compact structural unit as lifesaving means is thus afforded.

The control unit in another embodiment has means which are suitable for alternately processing one or more values from provided sensors:

position sensor and/or
motion sensor and/or
pressure sensor and/or
temperature sensor and/or
pulse sensor.

The position sensor serves to detect the actual position of the person in an emergency situation. For example, when the position that is safe in the event of unconsciousness is achieved, this is taken as a prompt to inflate a body element. However, it is first of all necessary to detect whether there is an emergency situation at all. The reason is that, when a person wearing a lifesaving means of this kind incorporated into a life jacket falls into the water for example, it is generally still not an emergency situation if the person is able to swim and can thus keep above the surface of the water.

However, if an emergency situation is reached, this is detected by at least one of the sensors. Decisive factors in this regard are the person's pulse, the body temperature and water temperature, active movements, but also the time spent in the water, for example beneath the surface of the water at a certain water pressure.

The sensors themselves may have a predetermined basic setting, continuously and automatically monitored by the control unit. This has the effect that, if the user is using the lifesaving means incorporated in an item of clothing or in a lifesaving means such as a flotation jacket, this means will function in any case. Moreover, the limit values of the measured values from the sensors can be defined such as, e.g., in a contactless manner. If one or more of the measured values from different sensors is exceeded, the control unit triggers an impulse which activates an inflation of the body elements. According to the control unit, there is then an emergency situation.

In another example, the control device may have a transmitter device, such that, for example, the data can be read out by means of a suitably equipped mobile communications system or a computer. The user himself can then set his parameters via suitable interfaces. This affords the advantage that, if a sailing enthusiast capsizes as a result of a given maneuver but has the situation under control and can get quickly back onboard the sailing boat, no emergency situation arises, and it is therefore not necessary that the lifesaving means triggers its corresponding function. However, the life jacket which is being worn, and in which the lifesaving means is incorporated, gives the user the secure feeling of having at least a certain degree of buoyancy (here that of the flotation jacket), so as to be able to move safely on or in the water. However, these sensed parameters differ from person to person. These very settings, when tailored to the individual, should then provide corresponding safety. Moreover, the person can ascertain at any time whether the lifesaving means is active or not. A suitable application on the control unit itself, or else on the mobile communications system or computer, shows the user whether the lifesaving means is functional or whether it has corresponding defects. As has been mentioned, the functionality is may also be shown directly on the control unit.

Thus, a main advantage of the lifesaving means in this embodiment is also that different parameters are set in particular for the different areas of use. Thus, the lifesaving means can be used, on the one hand, for flotation aids (flotation jackets) for sailing enthusiasts, but also, on the other hand, can be integrated in a flotation aid for young children who are not yet of an age when they are able to swim.

A lifesaving means is thus provided in which the triggering parameters (for example the water depth, water temperature, body temperature, position of body, time, etc.) can be set by the user, in order to take account of different lifesaving requirements. In this way, the one lifesaving means can be used for different areas of use, for example regatta sailing, rowing, swimming, snorkeling, water-skiing, etc.

The lifesaving means therefore may be configured such that it serves as a comfortable flotation aid and, upon contact with water, makes it easier to move through the water. If an emergency situation arises, for example loss of consciousness, the lifesaving means is able to provide increased buoyancy (e.g., 100N, 150N or even 275N), which at the same time ensures safety when the user is unconscious. However, in contrast to the prior art, this only occurs in an emergency situation, and this function is provided completely automatically by the control device with the systems coupled to the control device.

A particular embodiment has a control unit which, in a closed structural unit, comprises one or more sensors, a processor unit for evaluating the sensors, and an energy supply unit. If a gas system is used to inflate the body elements, which gas system is to be stored in containers, this container is also a component part of the structural unit. The advantage afforded by this is that the structural unit as a whole can be exchanged both for maintenance purposes and also after a triggering procedure. Thus, installation errors and application errors can be avoided. The inflating with chemical media also provides a complete exchange. Generally, the pouch-like body elements are also exchanged.

The control unit may in one embodiment be designed in such a way that it unambiguously indicates to the user the preparedness of the lifesaving means. If an error function is present, for example such that the energy supply is no longer sufficient, the user receives a corresponding signal (acoustically, visually and/or by smart phone or tablet). An interrogation of the preparedness (and also an adjustment of the parameters) can thus also take place by bringing control unit and smart phone into contact (data transmission via Bluetooth or other wireless protocols).

The above-described control unit is not only suitable for the previously described embodiment of the lifesaving means. Instead, it can be applied to the simplest embodiment of a lifesaving means that can be inserted into a life jacket, in particular a flotation jacket. A simple form envisions a hose-like body element being inserted inside the life jacket and being inflated in an emergency and thus making available the necessary buoyancy force that is needed in the emergency. The control unit is responsible for the corresponding triggering in the emergency.

Thus, a highly versatile use of a single modular means for use in different areas, particularly in flotation aids which serve exclusively for buoyancy support, is conceivable. The insertion may be a structural unit (OEM), such that it can likewise be used by non-specialist manufacturers. In this way, among other things, the use of life jackets can also be increased.

Further embodiments will become clear from the following description, from the drawings and from the claims.

DETAILED DESCRIPTION OF PREFERRED EMBODIMENTS

Figure 1:
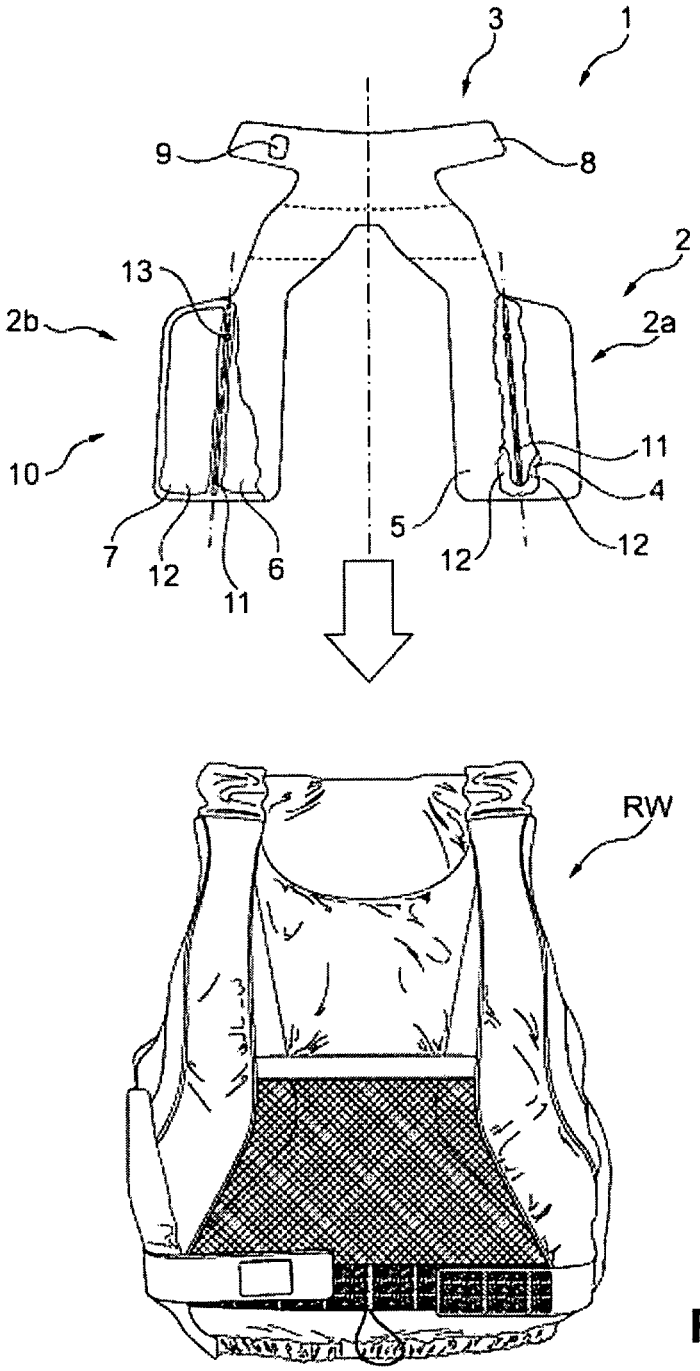
FIG. 1 shows a first schematic view of an embodiment of a life jacket into which an additional lifesaving means can be inserted.

FIG. 1 shows a first illustrative embodiment of a life jacket RW with a lifesaving means 1.

The lifesaving means 1 according to FIG. 1, which shows a preferred illustrative embodiment, is basically U-shaped in a plan view and thus consists of two limb elements 2*a*, 2*b* and of a limb base 3 that connects the limb elements 2*a*, 2*b* at one end.

Inflatable body elements 4, 5, 6, 7, 8 are provided at least in the limb elements 2*a*, 2*b*, but also in the limb base 3 in the illustrative embodiment shown here. A first inflatable body element 4 and a second inflatable body element 5 are provided in the first limb element 2*a*. A third body element 6 and a fourth body element 7 are provided in the second limb element 2*b*, while a fifth body element 8 is provided on the limb base 3.

In the illustrative embodiment shown here, a trigger mechanism 10 is provided in the first limb element 2*a*, which trigger mechanism 10 is controlled by a control unit 9, which is preferably arranged on the limb base 3.

Figure 2:
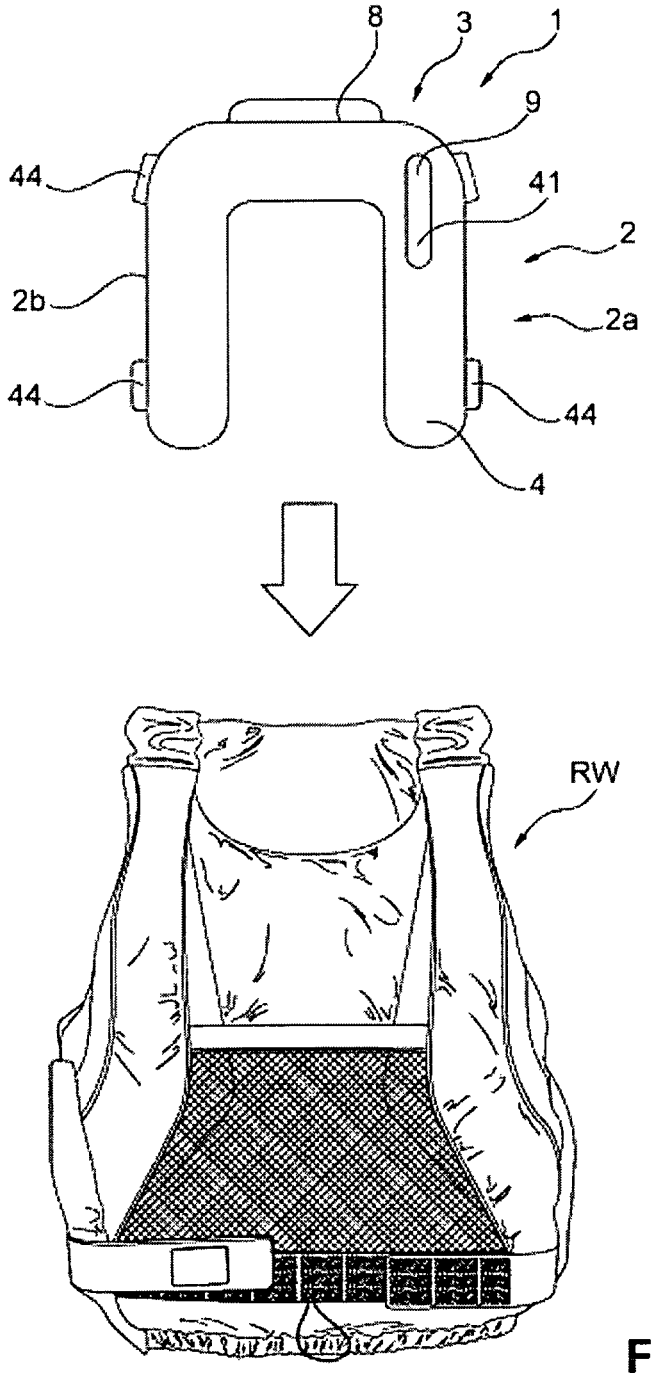
FIG. 2 shows a further illustrative embodiment of a life jacket into which an additional lifesaving means of another design can be inserted.

An electrical connection is present between the control unit 9 and the trigger unit 10 via a cable 14 (FIG. 2). The cable 14 ends at an ignition mechanism 13, which is constructed in such a way that a first medium is arranged on a flat and preferably flexible tube 11. This tube 11, which is part of the trigger mechanism, is connected to the respective inflatable body elements 4, 5, 6, 7, 8. In the inflatable body elements 4, 5, 6, 7, 8, a chemical medium is present which, by the ignition, comes into contact with the first liquid. Gases thus form that inflate the respective body element 4, 5, 6, 7, 8.

Either a further ignition mechanism is provided in the body element 8 arranged on the limb base 3, or one of the two ignition mechanisms 13 is configured in such a way that a fluid connection between one of the body elements in the limb elements 2*a*, 2*b* is fluidically connected to the body element 8 in the limb base 3.

The lifesaving means 1 is therefore a completely self-contained assembly that can be sewn into a life jacket.

FIG. 2 shows a further embodiment of the inventive design of a life jacket RW with a lifesaving means 1. The life jacket RW shown is a flotation jacket of the kind customarily used in sailing. It has a low buoyancy of ca. 50N.

In the illustrative embodiment shown here, the lifesaving means 1 is shown as a tubular body element 4, which is U-shaped in a plan view. For this purpose, it has a first limb element 2*a* and a further limb element 2*b*, which are either for arrangement in the chest area or in the side area of the life jacket RW. At the opposite, free end, the limb elements 2*a*, 2*b* are connected to a limb base 3. There is a fluidic connection between the limb elements 2*a*, 2*b* and the limb base 3. Moreover, a control device 9 is provided on the lifesaving means 1 and is combined with a gas cartridge 41.

The lifesaving means 1 detects the corresponding emergency and triggers the additional buoyancy element in the form of the body element 4 by releasing the gas cartridge 41. In this way, in addition to the existing buoyancy force of 50N, an additional buoyancy force of up to 275N in total is made available for a life jacket.

A collar element 8 is additionally provided on the lifesaving means. This collar element 8 can also be fluidically connected to the body element 4, such that it correspondingly rolls out in the event of an emergency, and the collar support and/or head support makes available a design that is safe if the wearer is unconscious.

Fixing aids 44 are also provided. These are used to fix the lifesaving means 1 inside the life jacket RW.

The life jacket RW and lifesaving means 1 thus make available a device which automatically supplies an increased buoyancy force (more than 100N), exclusively in the event of an emergency being detected.

The lifesaving means 1 in FIG. 2 is of a simpler construction compared to the lifesaving means 1 shown in FIG. 1. It only has one body element. However, it is likewise possible that the control unit 9 is designed identically to the one in FIG. 1. As an alternative to this, a manual actuation can also be provided as control device 9. Thus, the trigger mechanism for the flow of gas out of the gas cartridge 41 can be provided, for example, by pushing a button or pulling a corresponding tab.

The control device 9 serves to ensure that the values detected by sensors S or by one sensor S are compared against an internal database in order to establish whether the value exceeds a predetermined limit value. If no value is found to have exceeded the limit value, no triggering takes place. If either one value or several values has/have been exceeded, the control unit 9 transmits an impulse to the trigger mechanism, since an emergency according to the predetermined values exists. The impulse in turn causes the body elements to inflate, thus making available a considerably greater buoyancy. In the illustrative embodiments shown in the drawings, in particular in FIGS. 1 and 2, control unit 9 and sensors S form one structural unit. For the sake of simplicity, the latter is labeled only with the reference sign 9. The following can be provided as sensors, for example:

position sensor and/or
motion sensor and/or
pressure sensor and/or
temperature sensor and/or
pulse sensor.

Figure 3:
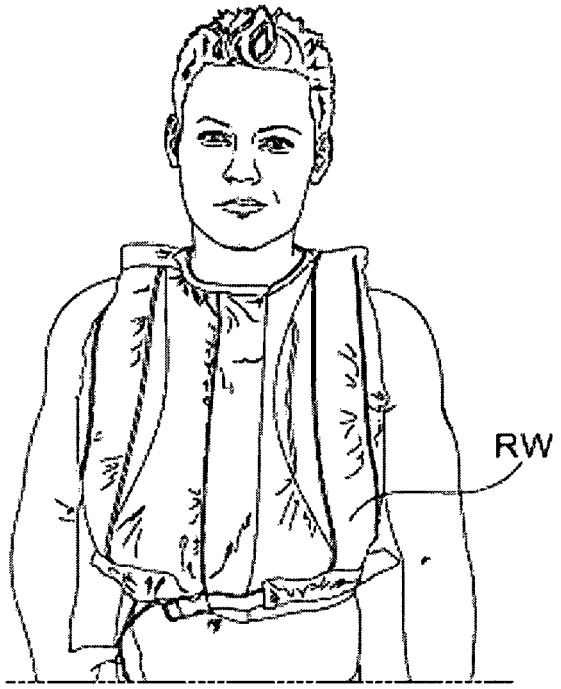
FIG. 3 shows a front view of an embodiment of a life jacket with the lifesaving means, in the non-activated state of the lifesaving means.

In FIG. 3, a life jacket RW is shown on the body of a person. The life jacket RW can include both the lifesaving means according to FIG. 1 and also the lifesaving means according to FIG. 2.

Figure 4:
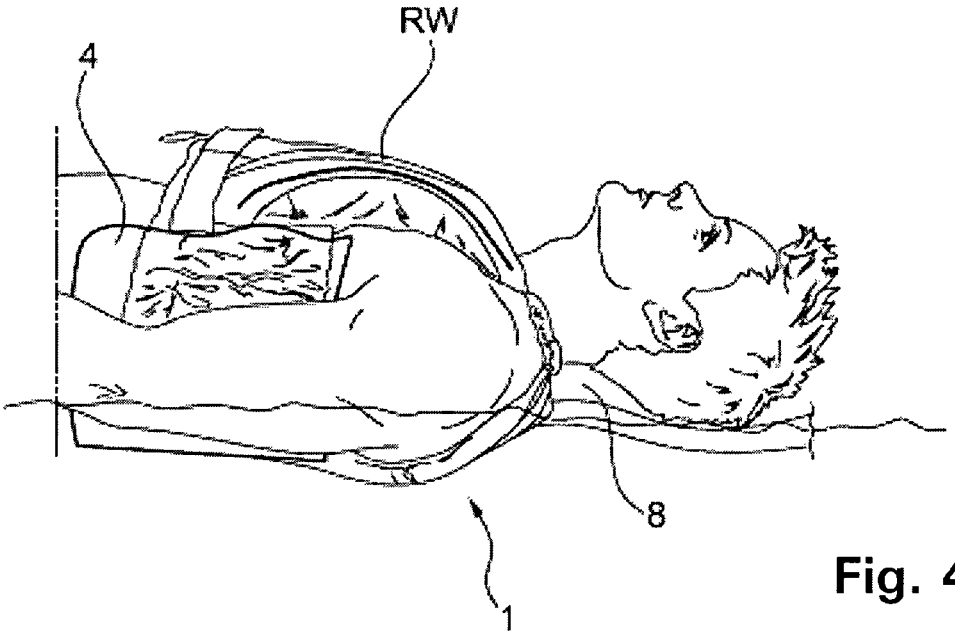
FIG. 4 shows a side view of the embodiment of the life jacket according to the invention but with the lifesaving means inflated.

In the non-activated state, the life jacket RW does not differ from a previous life jacket RW as flotation aid. Instead, it too provides the usual buoyancy force of ca. 50N. In the activated state, as is shown in FIG. 4 for example, the lifesaving means 1 triggered in accordance with FIG. 1 has the inflated body elements 4, or the further body element not visible, and also the head element 8. The life jacket RW with the inflated lifesaving means 1 thus has the function whereby the body of the person now located in an emergency situation is above the water line W so as to permit floating. A large part of the body element 4 is below water and supplies the necessary buoyancy. Stabilization is provided by the lateral arrangements of body elements and also by the head element 8.

Figure 5:
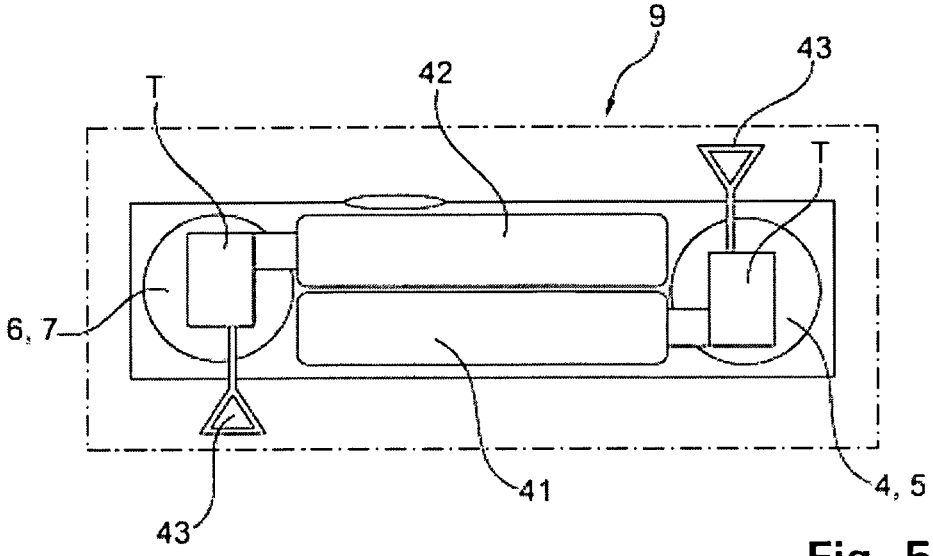
FIG. 5 shows a schematic view of a further embodiment of a control unit.
Figure 6:
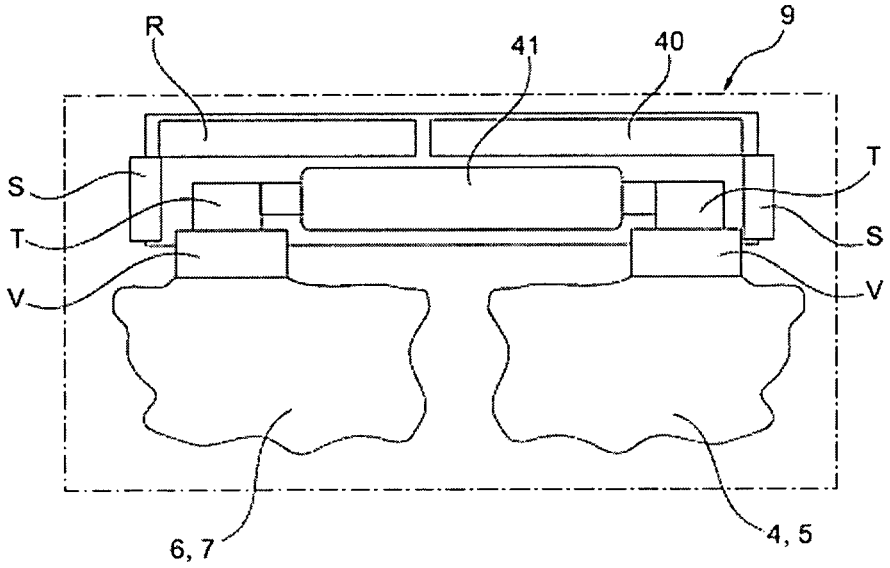
FIG. 6 shows a side view of the control unit according to FIG. 5.

FIG. 5 and FIG. 6 show an illustrative embodiment of a compact control unit 9. This control unit 9 differs from the aforementioned control unit in that, instead of materials combining chemically to inflate the body elements 4, 5, 6, 7 shown, gas cartridges 41, 42 are provided. In the illustrative embodiment shown here, the body elements 4, 5 of the one limb element 2*a* are supplied with a first gas cartridge 41, whereas the two further body elements 6, 7 of the further limb element 2*b* are supplied via a further gas cartridge 42.

The control unit 9 shown here is designed as a compact structural element. It can also be easily removed as an autonomous unit from the lifesaving means 1 and can be replaced by a new compact structural unit. This affords the advantage that, by virtue of maintenance and the replacement of no longer functioning parts, no incorrect operation can arise. The unit is autonomous per se and simply has to be inserted into the corresponding structural element.

Moreover, the control unit 9 is provided with sensors S and also with a microprocessor R, which is fed from a current supply 40. The sensors S transmit the physical data preferably according to the predetermined scheme in FIG. 6, which data are then correspondingly evaluated by the microprocessor R. If limit values are exceeded, a signal is transmitted via a signal on the trigger mechanism T, which is connected to the body elements 4, 5, 6, 7 via a connection element V for example, which signal serves to ensure that the gas stored in the gas cartridges 41, 42 can flow out into the body elements 4, 5, 6 and 7.

A manually operated element 43 is additionally provided, which means that the release of the gas, stored in the gas cartridges 41, 42, into the body elements 4, 5, 6, 7 can be triggered by hand.

A life jacket RW is thus made available which, proceeding from a buoyancy not suitable for an emergency and thus for loss of consciousness, is modified in such a way that a function is now provided that automatically supplies an additional buoyancy exclusively in the event of an emergency, which itself can be defined. This is achieved by the fact that a life jacket is developed in such a way that it is provided with an additional lifesaving means which, by means of corresponding buoyancy bodies, automatically supplies the additional buoyancy force. The triggering itself can be effected via electronic and/or mechanical control means but can also be performed by hand.

LIST OF REFERENCE SIGNS

Life jacket having additional lifesaving means, and lifesaving means for arrangement in flotation aids or life jackets

1 lifesaving means
2*a*, 2*b* limb element
3 limb base
4,5,6,7,8 inflatable body elements
9 control unit
10 trigger mechanism
11 tube
13 ignition mechanism
14 cable
40 current supply
41 gas cartridge
42 gas cartridge
43 manually operated element
44 fixing aid
R microprocessor
RW life jacket
S sensors T trigger mechanism
W water line

What is claimed is:

1. A lifesaving device for persons, wherein the lifesaving device comprises at least one buoyancy body that supplies a first buoyancy force, wherein the lifesaving device is additionally provided with lifesaving means comprising one or more body elements, which automatically supply a further buoyancy force in an emergency;

wherein the lifesaving means is triggered automatically by a control unit; and wherein the body elements are inflated by triggering by an automatic device, which is coupled to the control unit, if one or more predefined limit values are exceeded by one or more corresponding measured values; and wherein the control unit detects a currently present status via one or more sensors, said sensors establish one or more of position, movement, pressure, temperature and pulse as said one or more measured values; and wherein the control unit compares the one or more measured values provided by the sensors with an internal database in order to establish whether one of said measured values exceeds the corresponding predefined limit value; and wherein the user defines said one or more predefined limit values with an electronic aid in such a way that different limit values can be used for different areas of use and different lifesaving requirements.

2. The lifesaving device as claimed in claim 1, wherein the lifesaving means and the control unit form one structural unit.

3. The lifesaving device as claimed in claim 1, wherein the lifesaving device is a life jacket.

4. The lifesaving device as claimed in claim 1, wherein the lifesaving device is a life vest.

5. The lifesaving device as claimed in claim 1, wherein the lifesaving device is a flotation aid.

6. The lifesaving device as claimed in claim 1, wherein the triggering also takes place manually.

7. The lifesaving device as claimed in claim 1, wherein two body elements are provided which are either fluidically connected to each other or are designed separately and independent of each other.

8. The lifesaving device as claimed in claim 7, wherein the body elements comprise two limb elements which are connected to each other by a limb base.

9. The lifesaving device as claimed claim 1, wherein the at least one buoyancy body has a buoyancy of at least 50N, and, together with the activated lifesaving means, the buoyancy is more than 100N.

10. The lifesaving device as claimed claim 1, wherein the at least one buoyancy body is a static buoyancy body.

11. A flotation aid for persons, wherein the flotation aid comprises at least one buoyancy body that supplies a first buoyancy force, wherein the flotation aid is additionally provided with lifesaving means comprising one or more body elements, which automatically supply a further buoyancy force in an emergency;

wherein the lifesaving means is triggered automatically by a control unit; and wherein the body elements are inflated by triggering by an automatic device, which is coupled to the control unit, if one or more predefined limit values are exceeded by one or more corresponding measured values; and wherein the control unit detects a currently present status via one or more sensors, said sensors establish one or more of position, movement, pressure, temperature and pulse as said one or more measured values; and wherein the control unit compares the one or more measured values provided by the sensors with an internal database in order to establish whether one of said measured values exceeds the corresponding predefined limit value; and wherein the user defines said one or more predefined limit values with an electronic aid in such a way that different limit values can be used for different areas of use and different lifesaving requirements.

12. Lifesaving means for arrangement in flotation aids, life jackets or life vests that have at least one buoyancy body, said lifesaving means comprising one or more body elements, which automatically supply a further buoyancy force in an emergency;

wherein the lifesaving means is triggered automatically by a control unit; and wherein the body elements are inflated by triggering by an automatic device, which is coupled to the control unit, if one or more predefined limit values are exceeded by one or more corresponding measured values; and wherein the control unit detects a currently present status via one or more sensors, said sensors establish one or more of position, movement, pressure, temperature and pulse as said one or more measured values; and wherein the control unit compares the one or more measured values provided by the sensors with an internal database in order to establish whether one of said measured values exceeds the corresponding predefined limit value; and wherein the user defines said one or more predefined limit values with an electronic aid in such a way that different limit values can be used for different areas of use and different lifesaving requirements.

* * * * *